US012180572B2

(12) United States Patent
Takayama et al.

(10) Patent No.: US 12,180,572 B2
(45) Date of Patent: Dec. 31, 2024

(54) WEAR-RESISTANT STEEL PLATE AND METHOD FOR PRODUCING SAME

(71) Applicant: JFE STEEL CORPORATION, Tokyo (JP)

(72) Inventors: Naoki Takayama, Tokyo (JP); Shigeki Kitsuya, Tokyo (JP); Yoshiaki Murakami, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 526 days.

(21) Appl. No.: 17/753,552

(22) PCT Filed: Aug. 17, 2020

(86) PCT No.: PCT/JP2020/031028
§ 371 (c)(1),
(2) Date: Mar. 8, 2022

(87) PCT Pub. No.: WO2021/054015
PCT Pub. Date: Mar. 25, 2021

(65) Prior Publication Data

US 2022/0333227 A1 Oct. 20, 2022

(30) Foreign Application Priority Data

Sep. 17, 2019 (JP) ..... 2019-168182

(51) Int. Cl.
*C22C 38/38* (2006.01)
*C21D 8/04* (2006.01)
*C22C 38/02* (2006.01)

(52) U.S. Cl.
CPC ..... *C22C 38/38* (2013.01); *C21D 8/0405* (2013.01); *C21D 8/0426* (2013.01); *C22C 38/02* (2013.01); *C21D 2211/008* (2013.01)

(58) Field of Classification Search
CPC ..... C22C 38/38; C22C 38/02; C21D 8/0405; C21D 8/0426; C21D 2211/008
See application file for complete search history.

(56) References Cited

U.S. PATENT DOCUMENTS 11,035,018 B2 6/2021 Terazawa et al.
11,118,240 B2 9/2021 Terazawa et al.
(Continued)

FOREIGN PATENT DOCUMENTS

CN 109072367 A 12/2018
CN 109072368 A 12/2018
(Continued)

OTHER PUBLICATIONS

Terasawa Yusuke et.al. [JP2018123409A] (machine translation) (Year: 2018).*
(Continued)

*Primary Examiner* — Brian D Walck
*Assistant Examiner* — Nazmun Nahar Shams
(74) *Attorney, Agent, or Firm* — KENJA IP LAW PC

(57) ABSTRACT

The steel plate has a specific chemical composition, and a microstructure where a volume fraction of martensite at a depth of 1 mm from a surface of the steel plate is 95% or more, and at a depth of 1 mm from a surface of the steel
(Continued)

plate, a Vickers hardness at 400° C. is 288 or more, and a Brinell hardness at 25° C. is 360 HBW10/3000 to 490 HBW10/3000.

4 Claims, 2 Drawing Sheets

(56) References Cited

U.S. PATENT DOCUMENTS

| | | | | |
|---|---|---|---|---|
| 2010/0139820 | A1 | 6/2010 | Kumagai et al. | |
| 2013/0216422 | A1 | 8/2013 | Ueda et al. | |
| 2016/0060721 | A1 | 3/2016 | Nagao et al. | |
| 2019/0062882 | A1* | 2/2019 | Ishikawa | C21D 6/001 |
| 2019/0390293 | A1 | 12/2019 | Yu et al. | |
| 2020/0354808 | A1 | 11/2020 | Mizoguchi et al. | |

FOREIGN PATENT DOCUMENTS

| | | | |
|---|---|---|---|
| JP | H10204575 | A | 8/1998 |
| JP | 2002115024 | A | 4/2002 |
| JP | 2004300474 | A | 10/2004 |
| JP | 4645306 | B2 | 3/2011 |
| JP | 4735191 | B2 | 7/2011 |
| JP | 2016125065 | A | 7/2016 |
| JP | 2017193739 | A | 10/2017 |
| JP | 2017193740 | A | 10/2017 |
| JP | 2018048399 | A | 3/2018 |
| JP | 2018123409 | A | 8/2018 |
| WO | 2018117481 | A1 | 6/2018 |
| WO | 2019181130 | A1 | 9/2019 |

OTHER PUBLICATIONS

Aug. 21, 2023, the Extended European Search Report issued by the European Patent Office in the corresponding European Patent Application No. 20866668.5.

Jul. 5, 2022, Office Action issued by the China National Intellectual Property Administration in the corresponding Chinese Patent Application No. 202080064728.4 with English language search report.

Jul. 24, 2024, Office Action issued by the Korean Intellectual Property Office in the corresponding Korean Patent Application No. 10-2022-7012265 with English language concise statement of relevance.

Mar. 23, 2023, Office Action issued by the IP Australia in the corresponding Australian Patent Application No. 2020350261.

Nov. 24, 2020, International Search Report issued in the International Patent Application No. PCT/JP2020/031028.

Nov. 30, 2021, Notification of Reasons for Refusal issued by the Japan Patent Office in the corresponding Japanese Patent Application No. 2021-507722 with English language Concise Statement of Relevance.

Jan. 24, 2024, Office Action issued by the Korean Intellectual Property Office in the corresponding Korean Patent Application No. 10-2022-7012265 with English language concise statement of relevance.

Nov. 7, 2024, Office Action issued by the Korean Intellectual Property Office in the corresponding Korean Patent Application No. 10-2022-7012265 with English language concise statement of relevance.

* cited by examiner

WEAR-RESISTANT STEEL PLATE AND METHOD FOR PRODUCING SAME

TECHNICAL FIELD

This disclosure relates to a wear-resistant steel plate that can be suitably used in various members of steel structures in construction machinery, industrial machinery, shipbuilding, civil engineering, building and the like, as well as a method for producing the same. This disclosure particularly relates to a wear-resistant steel plate to be used at high temperatures.

BACKGROUND

The wear resistance of steel is known to be improved by increasing the hardness of the steel. Therefore, high-hardness steel has been widely used as wear-resistant steel, the high-hardness steel being obtained by subjecting alloy steel added with a large amount of alloying elements to heat treatment such as quenching.

For example, JP 4645306 B (PTL 1) and JP 4735191 B (PTL 2) propose a wear-resistant steel plate having a Brinell hardness (HB) of 360 to 490 in its surface layer. In the wear-resistant steel plate, high wear resistance is achieved by adding a predetermined amount of alloying elements and quenching the steel plate to obtain a martensite-based microstructure.

Here, there are many cases in application of the wear-resistant steel where the temperature of the steel plate surface is as high as 300° C. to 500° C. It is important to ensure not only wear resistance at room temperature but also high wear resistance at high temperatures for extending the service life at such high temperatures.

For example, JP H10-204575 A (PTL 3) proposes a technology that improves the wear resistance at such high temperatures, where high wear resistance at high temperatures is achieved by adding predetermined alloy elements and dispersing composite precipitates.

CITATION LIST

Patent Literature

PTL 1: JP 4645306 B
PTL 2: JP 4735191 B
PTL 3: JP H10-204575 A

SUMMARY

Technical Problem

However, even wear-resistant steel, which is generally used at high temperatures, is not always exposed to high temperature conditions and may be used under low temperature conditions depending on the usage conditions. Therefore, it is required to have both high wear resistance at high temperatures and toughness at low temperatures. Although PTL 3 studied improvement in wear resistance as well as the toughness at low temperatures, it is difficult to obtain satisfactory toughness at low temperatures because the high wear resistance at high temperatures is achieved by adding predetermined alloying elements and dispersing composite precipitates.

It could thus be helpful to provide a wear-resistant steel plate having both high wear resistance at high temperatures of 300° C. to 500° C. and toughness at low temperatures as well as a method for producing the same.

Solution to Problem

To achieve the above object, we made intensive studies as to various factors which affect the wear resistance at high temperatures of a wear-resistant steel plate. It is found that the wear resistance at high temperatures is greatly affected by the hardness at high temperatures. In other words, it is important to suppress a decrease in hardness at high temperatures for improving the wear resistance at high temperatures. Specifically, it is found that excellent wear resistance at high temperatures is exhibited by setting the Vickers hardness HV400 at a test temperature of 400° C. to 288 or more.

Further research has indicated that adding a predetermined amount or more of Cr and, if necessary, Mo is effective in controlling a decrease in hardness at high temperatures, and that it is necessary to add components satisfying 1.0≤0.45 Cr+Mo to obtain a Vickers hardness HV400 at a test temperature of 400° C. of 288 or more as described above.

First, the experimental results serving as a foundation for the present disclosure are described.

A steel material (slab) having a chemical composition containing, in mass %, 0.14% C-0.25% Si-0.50% Mn-0.005% P-0.002% S-0.015% Ti-0.03% Al-(0~4.5)% Cr-(0~2.25)% Mo was heated to 1150° C. and then subjected to hot rolling to obtain a hot-rolled plate with a thickness of 25 mm. The steel plate after hot rolling was subjected to air cooling and reheated at a heating temperature equal to or higher than the $Ac_3$ point indicated in the following formula (i), and then the steel plate was subjected to quenching treatment in which it is cooled to room temperature by water cooling.

$$Ac3(^\circ C.)=912.0-230.5\times C+31.6\times Si-20.4\times Mn-39.8\times Cu-18.1\times Ni-14.8\times Cr+16.8\times Mo \quad (i)$$

A cylindrical test piece (8 mm in diameter×20 mm in length) was collected from the obtained steel plate so that a position of 1 mm in the thickness direction was the surface of the test piece (wear test surface), and a wear test was performed at high temperatures. The wear test used the wear tester schematically illustrated in FIG. 1.

That is, the temperature of an atmosphere furnace in which the wear tester was installed kept was at 400° C., the test piece was placed on a disk-shaped wear material (main component: alumina) connected to a rotor in the tester, and the test was performed by rotating the wear material 300 times at a rotor rotational speed of 60 m/min while applying a load of 98 N by a weight connected to the upper part of the test piece. The amount of wear after the test was measured, evaluation was performed by determining the wear resistance ratio=(amount of wear of mild steel plate)/(amount of wear of each steel plate) with the method for evaluating wear resistance at high temperatures in the Examples section described below. When the wear resistance ratio was 1.8 or more, it was judged to have "excellent wear resistance at high temperatures".

The results of the wear test are organized and illustrated in FIG. 2. From the results of FIG. 2, it can be seen that it is effective to add a predetermined amount or more of Cr and, if necessary, Mo for improving the wear resistance at high temperatures, where, specifically, it is effective to set the contents to satisfy 1.0≤0.45 Cr+Mo, which is the region bounded by the dotted line.

Further, it is understood that, in a temperature range of 300° C. to 500° C., solute Cr and Mo are particularly effective for wear resistance. That is, for conventional heat-resistant steel used at temperatures higher than the above temperature range, it is customary to add a large amount of Cr or Mo to a ferrite microstructure to precipitate carbonitrides to exhibit hardness at high temperatures. The above study results of the present disclosure are based on an idea different from the conventional heat-resistant steel.

Furthermore, solute Cr and Mo contribute to wear resistance at high temperatures and have an advantage of precipitating carbonitrides to provide good toughness at low temperatures.

The present disclosure is based on the aforementioned discoveries and further studies. We thus provide the following.

1. A wear-resistant steel plate, comprising a chemical composition containing (consisting of), in mass %, C: 0.10% or more and 0.23% or less, Si: 0.05% or more and 1.00% or less, Mn: 0.10% or more and 2.00% or less, P: 0.050% or less, S: 0.050% or less, Al: 0.050% or less, Cr: 1.00% or more and 5.00% or less, N: 0.0100% or less, and O: 0.0100% or less, with the balance being Fe and inevitable impurities, wherein the chemical composition satisfies the formula (1)

$$1.00 \leq 0.45Cr+Mo \leq 2.25 \quad (1),$$

where the element symbol in the formula (1) is a content of each element in mass %, and a content of an element that is not contained is 0, and a microstructure wherein a volume fraction of martensite at a depth of 1 mm from a surface of the steel plate is 95% or more, and at a depth of 1 mm from a surface of the steel plate, a Vickers hardness at 400° C. is 288 or more, and a Brinell hardness at 25° C. is 360 HBW10/3000 to 490 HBW10/3000.

2. The wear-resistant steel plate according to 1, wherein the chemical composition further contains, in mass %, at least one selected from the group consisting of Mo: 1.80% or less, Cu: 5.00% or less, Ni: 5.00% or less, V: 1.00% or less, W: 1.00% or less, Co: 1.00% or less, Nb: 0.050% or less, Ti: 0.100% or less, B: 0.0100% or less, Ca: 0.0200% or less, Mg: 0.0200% or less, and REM: 0.0200% or less.

A method for producing a wear-resistant steel plate, which is a method for producing the wear-resistant steel plate according to 1. or 2, comprising subjecting a steel material to hot rolling to obtain a hot-rolled steel plate, and subjecting the hot-rolled steel plate to direct quenching where a cooling start temperature is equal to or higher than $Ar_3$ transformation point, a cooling stop temperature is equal to or lower than Ms point, and a cooling rate is 5° C./s or higher, or to reheating quenching where a cooling start temperature is equal to or higher than $Ac_3$ transformation point, a cooling stop temperature is equal to or lower than Mf point, and a cooling rate is 5° C./s or higher.

Advantageous Effect

According to the present disclosure, it is possible to provide a wear-resistant steel plate which exhibits high wear resistance at high temperatures, thereby achieving significantly advantageous effects in industrial terms.

DETAILED DESCRIPTION

Figure 1:
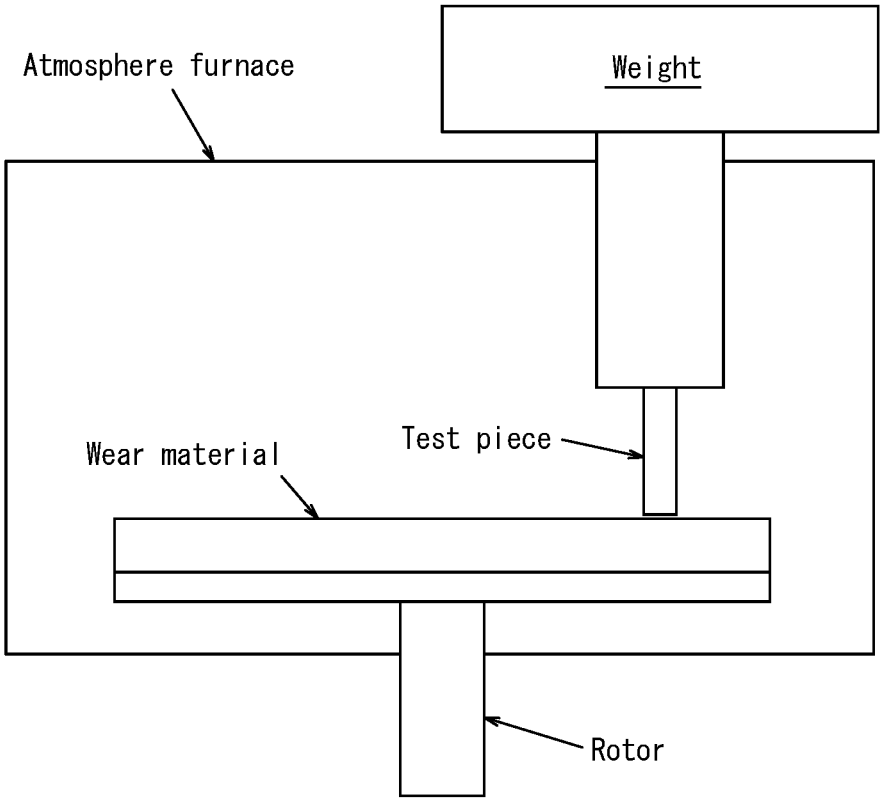
FIG. 1 schematically illustrates a wear tester.
Figure 2:
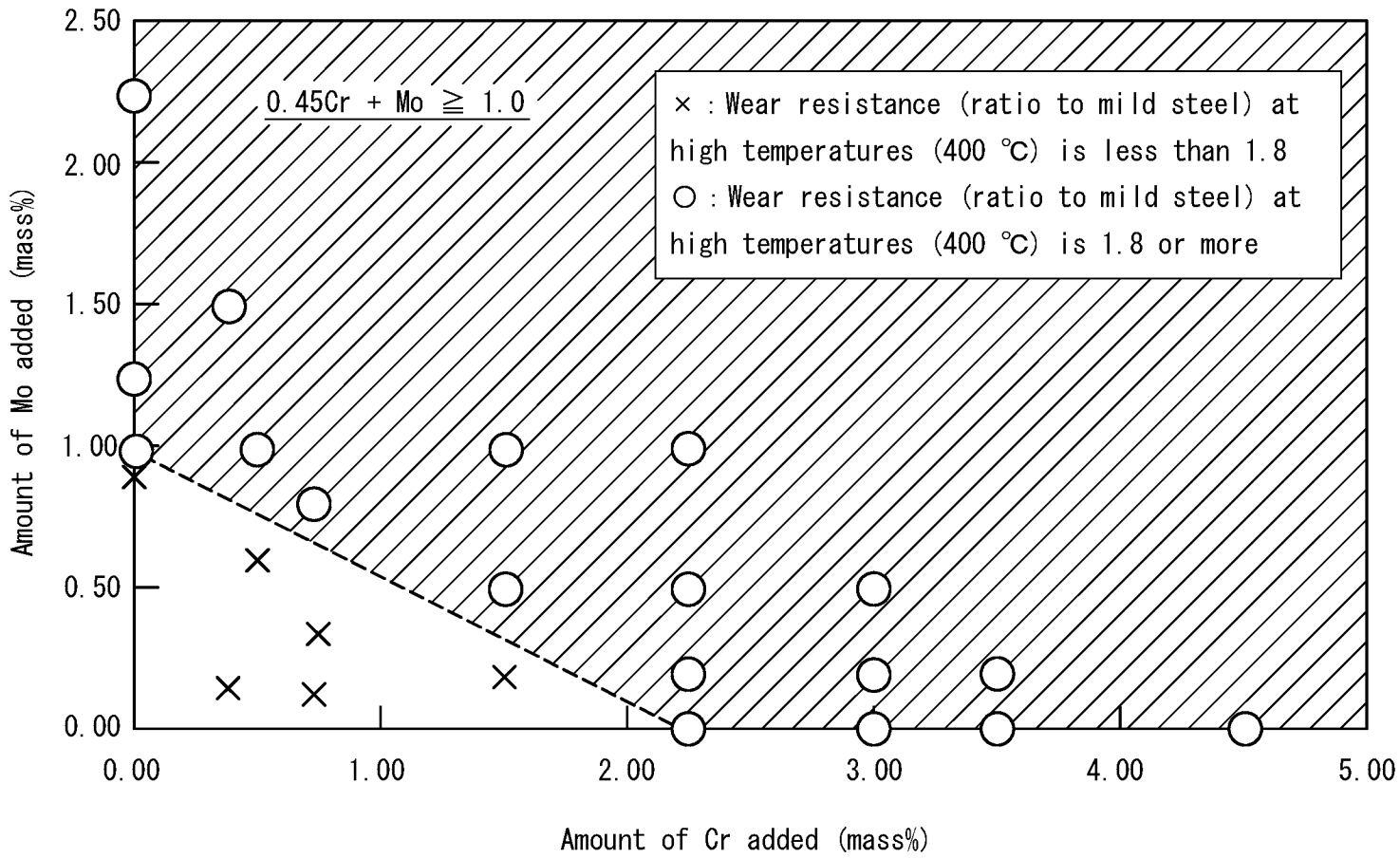
FIG. 2 illustrates the relationship between the contents of Cr and Mo and the results of a wear test.

The following describes a wear-resistant steel plate of the present disclosure in detail. In the present disclosure, it is important that a wear-resistant steel plate and a steel material used for its production have the chemical composition described above. Therefore, reasons for limiting the steel chemical composition of the present disclosure as above are described first. As used herein, the "%" representations below relating to the chemical composition are in "mass %" unless otherwise specified.

[Chemical Composition]

C: 0.10% or More and 0.23% or Less

C is an element that increases the hardness in a surface layer of a steel plate and improves the wear resistance. Further, it suppresses a decrease in hardness at high temperatures and improves the wear resistance in high-temperature environments, which is one of the important elements in the present disclosure. To obtain these effects, the C content is set to 0.10% or more. From the viewpoint of reducing the content of other alloying elements and producing the steel plate at reduced costs, the C content is preferably 0.12% or more. On the other hand, when the C content exceeds 0.23%, carbides are easily formed, resulting in a decrease in hardness at high temperatures. In addition, the surface hardness at room temperature increases, which deteriorates the toughness. Therefore, the C content is set to 0.23% or less. From the viewpoint of suppressing a decrease in hardness at high temperatures or suppressing a decrease in toughness, the C content is preferably 0.21% or less.

Si: 0.05% or More and 1.00% or Less

Si is an element that acts as a deoxidizer. Si also has an effect of being dissolved in steel and increasing the hardness of a matrix of the steel by solid solution strengthening. To obtain these effects, the Si content is set to 0.05% or more. The Si content is preferably 0.10% or more and more preferably 0.20% or more. On the other hand, when the Si content exceeds 1.00%, problems such as a decrease in toughness and an increase in inclusions occur. Therefore, the Si content is set to 1.00% or less. The Si content is preferably 0.80% or less, more preferably 0.60% or less, and still more preferably 0.40% or less.

Mn: 0.10% or More and 2.00% or Less

Mn is an element that has an effect of increasing the hardenability of steel and is an element that increases the hardness of a surface layer of a steel plate to improve the wear resistance. Further, it exists as a solute and has an effect of suppressing a decrease in hardness at high temperatures.

To obtain these effects, the Mn content is set to 0.10% or more. The Mn content is preferably 0.30% or more and more preferably 0.50% or more. On the other hand, when the Mn content exceeds 2.00%, the toughness is deteriorated, and alloy costs are excessively increased. Therefore, the Mn content is set to 2.00% or less. The Mn content is preferably 1.80% or less and more preferably 1.60% or less.

P: 0.050% or Less

P is an element contained as an inevitable impurity, which causes adverse effects such as lowering the toughness of base metal by segregation at grain boundaries. Therefore, the P content is desirably as low as possible, but a content of 0.050% or less is acceptable. On the other hand, the P content may have any lower limit. The lower limit may be 0%, but in industrial terms, it may be more than 0% because P is typically an element inevitably contained as an impurity in steel. Further, excessively reducing the P content leads to an increase in refining costs. Therefore, the P content is preferably 0.0005% or more.

S: 0.050% or Less

S is an element contained as an inevitable impurity. It exists in steel as sulfide inclusions such as MnS and causes adverse effects such as lowering the toughness of base metal. Therefore, the S content is desirably as low as possible, but a content of 0.050% or less is acceptable. On the other hand, the S content may have any lower limit. The lower limit may be 0%, but in industrial terms, it may be more than 0% because S is typically an element inevitably contained as an impurity in steel. Further, excessively reducing the S content leads to an increase in refining costs. Therefore, the S content is preferably 0.0005% or more.

Al: 0.050% or Less

Al is an element that functions as a deoxidizer and has an effect of refining crystal grains. To obtain these effects, the Al content is preferably 0.010% or more. On the other hand, when the Al content exceeds 0.050%, oxide-based inclusions increase, the cleanliness decreases, and the toughness deteriorates. Therefore, the Al content is set to 0.050% or less. The Al content is preferably 0.040% or less and more preferably 0.030% or less.

Cr: 1.00% or More and 5.00% or Less

Cr is an element that increases the hardness in a surface layer of a steel plate and improves the wear resistance. Further, it exists as a solute, suppresses a decrease in hardness at high temperatures, and improves the wear resistance in high-temperature environments. It is one of the important elements in the present disclosure. To obtain these effects, the Cr content is set to 1.00% or more. The Cr content is preferably 1.25% or more and more preferably 1.50% or more.

On the other hand, when the Cr content exceeds 5.00%, Cr carbides are precipitated, resulting in deterioration of hardness at high temperatures. Excessive addition of Cr also causes deterioration of toughness. Therefore, the Cr content is set to 5.00% or less. The Cr content is preferably 4.50% or less and more preferably 4.00% or less.

N: 0.0100% or Less

N is an element contained as an inevitable impurity, which causes adverse effects such as lowering the toughness of base metal. However, a content of 0.0100% or less is acceptable. On the other hand, the N content may have any lower limit. The lower limit may be 0%, but in industrial terms, it may be more than 0% because N is typically an element inevitably contained as an impurity in steel.

O: 0.0100% or Less

O is an element contained as an inevitable impurity, which causes adverse effects such as lowering the toughness of base metal. However, a content of 0.0100% or less is acceptable. On the other hand, the 0 content may have any lower limit. The lower limit may be 0%, but in industrial terms, it may be more than 0% because O is typically an element inevitably contained as an impurity in steel.

Further, it is essential for the wear-resistant steel plate of the present disclosure to satisfy the following formula (1) with respect to the above basic components.

$$1.00 \leq 0.45Cr+Mo \leq 2.25 \quad (1)$$

In the present disclosure, a predetermined amount or more of Cr and, if necessary, Mo, which will be described later, are added to improve the wear resistance at high temperatures. In this way, the wear resistance at high temperatures is improved. Therefore, it is particularly important to satisfy the above formula (1) in the single addition of Cr or the combined addition of Mo and Cr, if necessary, to secure the hardness at 400° C. That is, when 0.45 Cr+Mo<1.0, the hardness at 400° C. at a depth of 1 mm from the surface layer is deteriorated, and the wear resistance at high temperatures is deteriorated. Therefore, it is specified that 1.00≤0.45 Cr+Mo. To further improve the wear resistance at high temperatures, it is preferably that 1.10≤0.45 Cr+Mo and more preferably 1.20≤0.45 Cr+Mo.

On the other hand, when 0.45 Cr+Mo>2.25, the toughness significantly deteriorates. Therefore, it is specified that 0.45 Cr+Mo 2.25.

The above is the basic chemical composition in the present disclosure. The present disclosure can further contain, optionally, at least one selected from the group consisting of Mo: 1.80% or less, Cu: 5.00% or less, Ni: 5.00% or less, V: 1.00% or less, W: 1.00% or less, Co: 1.00% or less, Nb: 0.050% or less, Ti: 0.100% or less, B: 0.0100% or less, Ca: 0.0200% or less, Mg: 0.0200% or less, and REM: 0.0200% or less.

Mo: 1.80% or Less

Mo, like Cr, is an element that has an effect of improving the wear resistance at high temperatures, and it can be added optionally to improve the wear resistance at high temperatures. When Mo is added, the Mo content is preferably 0.01% or more to obtain the effect. On the other hand, when the Mo content exceeds 1.80%, the toughness is deteriorated, and alloy costs are increased. Therefore, when Mo is added, the Mo content is set to 1.80% or less. Further, when Mo is added, the above formula (1) should be satisfied. In a case where a trace amount of Mo is detected in a Mo-free steel by chemical analysis, the analysis result shall be reflected in the above formula (1).

Cu: 5.00% or Less

Cu is an element that has an effect of improving the wear resistance at high temperatures, and it can be added optionally to improve the wear resistance at high temperatures. When Cu is added, the Cu content is preferably 0.01% or more to obtain the effect. On the other hand, when the Cu content exceeds 5.00%, the weldability is deteriorated, and alloy costs are increased. Therefore, when Cu is added, the Cu content is set to 5.00% or less.

Ni: 5.00% or Less

Ni, like Cu, is an element that has an effect of improving the wear resistance at high temperatures, and it can be added optionally to improve the wear resistance at high temperatures. When Ni is added, the Ni is preferably 0.01% or more to obtain the effect. On the other hand, when the Ni content exceeds 5.00%, the weldability is deteriorated, and alloy costs are increased. Therefore, when Ni is added, the Ni content is set to 5.00% or less.

V: 1.00% or Less

V, like Cu, is an element that has an effect of improving the wear resistance at high temperatures, and it may be optionally added to improve the hardness inside the steel plate. When V is added, the V content is preferably 0.01% or more to obtain the effects. On the other hand, when the V content exceeds 1.00%, the weldability is deteriorated, and alloy costs are increased. Therefore, when V is added, the V content is set to 1.00% or less.

W: 1.00% or Less

W, like Cu, is an element that has an effect of improving the wear resistance at high temperatures, and it can be added optionally to improve the wear resistance at high temperatures. When W is added, the W content is preferably 0.01% or more to obtain the effect. On the other hand, when the W content exceeds 1.00%, the weldability is deteriorated, and alloy costs are increased. Therefore, when W is added, the W content is set to 1.00% or less.

Co: 1.00% or Less

Co, like Cu, is an element that has an effect of improving the wear resistance at high temperatures, and it may be optionally added to improve the hardness inside the steel plate. When Co is added, the Co content is preferably 0.01% or more to obtain the effects. On the other hand, when the Co content exceeds 1.00%, the weldability is deteriorated, and alloy costs are increased. Therefore, when Co is added, the Co content is set to 1.00% or less.

Nb: 0.050% or Less

Nb is an element that contributes to improving the wear resistance at high temperatures. When Nb is added, the Nb content is preferably 0.005% or more and more preferably 0.007% or more to obtain the effect. On the other hand, when the Nb content exceeds 0.050%, a large amount of NbC is precipitated, which deteriorates the workability. Therefore, when Nb is added, the Nb content is set to 0.050% or less. The Nb content is preferably 0.040% or less. The Nb content is more preferably 0.030% or less.

Ti: 0.100% or Less

Ti is an element that has a strong tendency to form nitrides and has an effect of fixing N to decrease solute N. Therefore, the addition of Ti can improve the toughness of base metal and a welded portion. Further, in a case of adding both Ti and B, Ti fixes N to suppress precipitation of BN, thus improving an effect of B which increases the hardenability. When Ti is added, the Ti content is preferably 0.010% or more and more preferably 0.012% or more to obtain these effects. On the other hand, when the Ti content exceeds 0.100%, a large amount of TiC is precipitated, which deteriorates the workability. Therefore, when Ti is contained, the Ti content is set to 0.100% or less. The Ti content is preferably 0.090% or less. The Ti content is more preferably 0.080% or less.

B: 0.0100% or Less

B is an element which has an effect of significantly improving the hardenability even when it is added at a trace amount. Therefore, the addition of B contributes to formation of martensite during quenching and further improves the wear resistance. When B is added, the B content is preferably 0.0001% or more, more preferably 0.0005% or more, and still more preferably 0.0010% or more to obtain the effect. On the other hand, when the B content exceeds 0.0100%, the weldability is deteriorated. Therefore, when B is added, the B content is set to 0.0100% or less. The B content is preferably 0.0050% or less. The B content is more preferably 0.0030% or less.

Ca: 0.0200% or Less

Ca is an element that combines with S and has an effect of preventing the formation of, for example, MnS which extends long in a rolling direction. Therefore, the addition of Ca can provide morphological control on sulfide inclusions so that the sulfide inclusions may have a spherical shape, which can improve the toughness of a welded portion and the like. When Ca is added, the Ca content is preferably 0.0005% or more to obtain the effect. On the other hand, when the Ca content exceeds 0.0200%, the cleanliness of the steel is decreased. Decreased cleanliness leads to deterioration of surface characteristics because of increased surface defects and to deterioration of bending workability. Therefore, when Ca is added, the Ca content is set to 0.0200% or less.

Mg: 0.0200% or Less

Mg, like Ca, is an element that combines with S and has an effect of preventing the formation of, for example, MnS which extends long in a rolling direction. Therefore, the addition of Mg can provide morphological control on sulfide inclusions so that the sulfide inclusions may have a spherical shape, which can improve the toughness of a welded portion and the like. When Mg is added, the Mg content is preferably 0.0005% or more to obtain the effect. On the other hand, when the Mg content exceeds 0.0200%, the cleanliness of the steel is decreased. Decreased cleanliness leads to deterioration of surface characteristics because of increased surface defects and to deterioration of bending workability. Therefore, when Mg is added, the Mg content is set to 0.0200% or less.

REM: 0.0200% or Less

REM (rare earth metal), like Ca and Mg, is an element that combines with S and has an effect of preventing the formation of, for example, MnS which extends long in a rolling direction. Therefore, the addition of REM can provide morphological control on sulfide inclusions so that the sulfide inclusions may have a spherical shape, which can improve the toughness of a welded portion and the like. When REM is added, the REM content is preferably 0.0005% or more to obtain the effect. On the other hand, when the REM content exceeds 0.0200%, the cleanliness of the steel is decreased. Decreased cleanliness leads to deterioration of surface characteristics because of increased surface defects and to deterioration of bending workability. Therefore, when REM is added, the REM content is set to 0.0200% or less.

The wear-resistant steel plate of the present disclosure has the above-described chemical composition and has a microstructure in which the volume fraction of martensite at a depth of 1 mm from the surface of the steel plate is 95% or more. At a depth of 1 mm from the surface of the steel plate, the Vickers hardness at 400° C. is 288 or more, and the Brinell hardness at 25° C. is 360 HBW10/3000 to 490 HBW10/3000. The reasons for limiting the microstructure and the hardness of the steel as above are explained below.

[Microstructure]

The following describes the microstructure of the wear-resistant steel plate of the present disclosure.

[Volume fraction of martensite at depth of 1 mm from surface of steel plate: 95% or more]

When the volume fraction of martensite at a depth of 1 mm from the surface of the steel plate is less than 95%, the hardness of the matrix of the steel plate is decreased, which deteriorates the wear resistance. Therefore, the volume fraction of martensite is set to 95% or more. The residual microstructure other than martensite is not particularly limited, and it may be ferrite, pearlite, austenite, or bainite. On the other hand, the volume fraction of martensite is desirably as high as possible. Therefore, the upper limit of the volume fraction is not particularly limited, and it may be 100%. The volume fraction of martensite is a value at a position of a depth of 1 mm from the surface of the wear-resistant steel plate. The volume fraction of martensite can be measured with the method described in the Examples section below.

[Hardness]

[Vickers Hardness at 400° C.: 288 or More]

The wear resistance at high temperatures can be improved by increasing the hardness at high temperatures at a depth of 1 mm from the surface of the steel plate (which is also referred to as "surface layer"). When the hardness at 400° C. at a depth of 1 mm from the surface of the steel plate is less than 288, sufficient wear resistance cannot be obtained. It is preferably 306 or more. There is no need to specify an upper limit. However, from the viewpoint of low alloying and low costs, it is preferably 490 or less.

The reason for specifying the hardness at 400° C. is as follows. There are many cases in which the temperature of the steel plate surface is as high as 300° C. or higher in operating environments of the wear-resistant steel plate, so that the hardness at 400° C. is specified, where the temperature of 400° C. is much higher than the lower limit of the high temperature range.

As used herein, the Vickers hardness is a value measured at a position of a depth of 1 mm from the surface of the steel plate with a load of 1 kgf (test force: 9.8 N) in accordance with the provisions of JIS Z 2252 "method for measuring high-temperature Vickers hardness", in which a Vickers hardness tester (with a heating device attached) is used and the temperature of the test piece (steel plate) is kept at 400° C.

[Brinell Hardness at 25° C.: 360 HBW10/3000 to 490 HBW10/3000]

The wear resistance of the steel plate can be improved by increasing the hardness at a depth of 1 mm from the surface of the steel plate (surface layer). When the hardness at 25° C. of the surface layer of the steel plate is less than 360 HBW in Brinell hardness, sufficient wear resistance cannot be obtained. On the other hand, when the hardness at 25° C. of the surface layer of the steel plate exceeds 490 HBW in Brinell hardness, the toughness of base metal is deteriorated. Therefore, the hardness at 25° C. of the surface layer of the steel plate is set to 360 HBW to 490 HBW in Brinell hardness in the present disclosure. As used herein, the hardness is a Brinell hardness at a position of a depth of 1 mm from the surface of the wear-resistant steel plate. The Brinell hardness is a value measured using a tungsten hard ball with a diameter of 10 mm under a load of 3000 kgf (HBW10/3000).

The thickness of the steel plate of the present disclosure is not particularly limited, and a steel plate having a thickness of 100 mm, for example, may be applied in the present disclosure.

Next, a method for producing a wear-resistant steel plate of the present disclosure will be described.

A steel material having the chemical composition described above is heated and subjected to hot rolling to obtain a hot-rolled steel plate, and the hot-rolled steel plate is subjected to direct quenching where a cooling start temperature is equal to or higher than $Ar_3$ transformation point, a cooling stop temperature is equal to or lower than Mf point, and a cooling rate is 5° C./s or higher, or to reheating quenching where a cooling start temperature is equal to or higher than $Ac_3$ transformation point, a cooling stop temperature is equal to or lower than Mf point, and a cooling rate is 5° C./s or higher, to obtain a wear-resistant steel plate.

First, a method for producing the steel material is not particularly limited. However, it is preferably a steel material obtained by preparing a molten steel having the chemical composition described above with a well-known steelmaking method such as a converter and casting the molten steel with a well-known casting method such as a continuous casting to obtain a steel material such as a slab of predetermined dimensions. There is no problem in using a steel material such as a slab of predetermined dimensions obtained by ingot casting and blooming.

The obtained steel material is subjected to reheating directly without cooling, or subjected to reheating after cooling, preferably at a heating temperature of 900° C. or higher and 1250° C. or lower, to be hot rolled to obtain a steel plate with a desired plate thickness (thick plate thickness).

In the case where the steel material is subjected to reheating and hot rolling, when the reheating temperature of the steel material is lower than 900° C., the heating temperature is too low, and deformation resistance is increased, which increases the load on the hot rolling mill and may render the hot rolling difficult. On the other hand, when the temperature is higher than 1250° C., oxidation is remarkably promoted, which may increase oxidation loss and reduce the yield. Therefore, the reheating temperature is preferably 900° C. or higher and 1250° C. or lower. The temperature is more preferably 950° C. or higher and 1150° C. or lower. The rolling finish temperature is preferably 800° C. or higher and 950° C. or lower from the viewpoint of the load on the hot rolling mill.

Next, the steel plate after hot rolling is subjected to direct quenching treatment at a temperature equal to or higher than $Ar_3$ transformation point. This is because the quenching is started from an austenite state to obtain a martensite microstructure. Through the quenching treatment, the volume fraction of martensite at a depth of 1 mm from the surface of the steel plate is 95% or more, the Brinell hardness at 25° C. is 360 HBW10/3000 to 490 HBW10/3000, and the Vickers hardness at 400° C. is 288 or more. As described above, quenching at a temperature lower than $Ar_3$ transformation point cannot provide sufficient quenching, the hardness is reduced, and a microstructure with high wear resistance cannot be obtained.

For example, the $Ar_3$ transformation point can be determined by $$Ar_3(°\ C.)=910-273\times C-74\times Mn-57\times Ni-16\times Cr-9\times Mo-5\times Cu$$ (where the element symbol is the content of the element(in mass %)).

Further, the steel plate may, instead of being subjected to quenching immediately after hot rolling, be allowed to naturally cool after hot rolling and then reheated to a temperature of equal to or higher than $Ac_3$ transformation point and subjected to quenching treatment. This is because the quenching is started from an austenite state to obtain a martensite microstructure. Quenching at a temperature lower than $Ac_3$ transformation point cannot provide sufficient quenching, the hardness is reduced, and a microstructure with high wear resistance cannot be obtained.

For example, the $Ac_3$ transformation point can be determined by $$Ac_3(°\ C.)=912.0-230.5\times C+31.6\times Si-20.4\times Mn-39.8\times Cu-18.1\times Ni-14.8\times Cr+16.8\times Mo$$ (where the element symbol is the content of the element(in mass %)).

As used herein, the cooling rate during the direct quenching treatment and the reheating quenching treatment should be a cooling rate at which a martensite phase is formed, and it is specifically 5° C./s or higher. The upper limit of the cooling rate is not particularly limited. However, the cooling rate is preferably 200° C./s or lower in standard facilities because such standard facilities experience significantly large variation in microstructure characteristics of a steel plate in the longitudinal direction or the widthwise direction when the cooling rate exceeds 200° C./s.

Further, the stop temperature of the cooling is set to the Mf point or lower and preferably 150° C. or lower. This is because, when the stop temperature exceeds the Mf point, the volume fraction of martensite microstructure is insufficient, the hardness at 25° C. and the hardness at 400° C. are decreased, and the wear resistance at high temperatures is deteriorated.

For example, the Mf point can be determined by $$Mf(°\,C.)=410.5-407.3\times C-7.3\times Si-37.8\times Mn-20.5\times Cu-19.5\times Ni-19.8\times Cr-4.5\times Mo$$ (where the element symbol is the content of the element(in mass %)).

EXAMPLES

Each molten steel having the chemical composition listed in Table 1 was prepared by steelmaking and used as a steel material (slab). These steel materials (slabs) were subjected to hot rolling under the conditions listed in Table 2 of heating temperature and rolling finish temperature to obtain hot-rolled plates of the thicknesses listed in Table 2. Some of the hot-rolled plates were subjected to direct quenching treatment, in which the plates were quenched immediately after hot rolling. The remaining hot-rolled plates were allowed to naturally cool after hot rolling and subjected to reheating quenching treatment, in which the plates were reheated and then quenched.

The volume fraction of martensite and the hardness of surface layer (Brinell hardness at 25° C. and Vickers hardness at 400° C.) were measured at a depth of 1 mm from the surface of the obtained steel plates (surface layer), and the wear resistance of each steel plate at high temperatures was evaluated. The test method for each is as follows.

[Volume Fraction of Martensite]

The wear resistance of a steel plate is mainly determined by the hardness of the surface layer of the steel plate. Therefore, a sample was collected from each of the obtained steel plates so that a position at a depth of 1 mm from the surface was an observation plane. The surface of the sample was subjected to mirror polishing and nital etching, and then an area of 10 mm×10 mm was photographed using a scanning electron microscope (SEM). The area fraction of martensite was obtained by analyzing the captured images using an image analyzer.

[Hardness of Surface Layer]

First, a test piece for hardness measurement was collected from each of the obtained steel plates, and the Brinell hardness at a position of 1 mm in the thickness direction from the surface of the steel plate was measured at 25° C. in accordance with the provisions of JIS Z 2243 (1998). That is, 1 mm from the surface of the steel plate was ground off to remove the effects of scale and decarburized layer on the surface of the steel plate, and the Brinell hardness of the surface at a plane of 1 mm from the surface of the steel plate was measured at 25° C. In the measurement, a tungsten hard ball with a diameter of 10 mm was used, and a load was set to 3000 kgf.

The Vickers hardness at 400° C. was measured at a position of a depth of 1 mm from the surface of the steel plate with a load of 1 kgf (test force: 9.8 N) in accordance with the provisions of JIS Z 2252 "method for measuring high-temperature Vickers hardness", in which a Vickers hardness tester (with a heating device attached) was used and the temperature of the test piece (steel plate) was kept at 400° C. That is, 1 mm from the surface of the steel plate was ground off, and the Vickers hardness of the surface at a plane of 1 mm from the surface of the steel plate was measured at 400° C.

[Wear Resistance at High Temperatures]

A cylindrical test piece (8 mm in diameter×20 mm in length) was collected from the surface of each of the obtained steel plates so that a position of 1 mm in the thickness direction was the surface of the test piece (wear test surface), and a wear test was performed at high temperatures. The wear test was performed using the wear tester schematically illustrated in FIG. 1.

That is, the temperature of an atmosphere furnace in which the wear tester was installed was kept at 400° C., the test piece was placed on a disk-shaped wear material (main component: alumina) connected to a rotor in the tester, and the test was performed by rotating the wear material 300 times at a rotor rotational speed of 60 m/min while applying a load of 98 N by a weight connected to the upper part of the test piece.

After the test, the test piece was taken out, and the mass of the test piece was measured. The amount of wear was calculated from the difference in mass of the test piece before and after the test. The wear properties of each steel plate at high temperatures were evaluated by using the wear amount of the comparative material of steel plate No. 31 (steel sample ID U: mild steel plate) as a reference (=1.0) and determining the wear resistance ratio=(amount of wear of mild steel plate)/(amount of wear of each steel plate). When the wear resistance ratio at high temperatures was 1.8 or more, it was judged to have "excellent wear resistance at high temperatures".

The obtained results are also listed in Table 2.

(3) Charpy Impact Test

A V-notch test piece was collected from the direction perpendicular to the rolling direction (direction C) at a position of ¼ thickness of each of the obtained steel plates, and a Charpy impact test was performed in accordance with the provisions of JIS Z 2242 (1998). The test temperature was −40° C., and an absorbed energy vE-40 (J) at this temperature was determined. The number of the test pieces was three for each steel plate, and the arithmetic mean thereof was used as the absorbed energy vE-40 of the steel plate. A steel plate having a vE-40 of 27 J or more was judged to be a "steel plate with excellent toughness in base metal".

TABLE 1

| Steel sample ID | (mass %) C | Si | Mn | P | S | Al | Cr | N | O | Mo | Cu | Ni | V | W | Co |
|---|---|---|---|---|---|---|---|---|---|---|---|---|---|---|---|
| A | 0.14 | 0.17 | 1.38 | 0.004 | 0.028 | 0.027 | 2.36 | 0.0030 | 0.0038 | — | — | — | — | — | — |
| B | 0.22 | 0.39 | 1.26 | 0.003 | 0.022 | 0.002 | 4.61 | 0.0046 | 0.0026 | — | — | — | — | — | — |
| C | 0.12 | 0.49 | 1.32 | 0.001 | 0.019 | 0.001 | 3.05 | 0.0037 | 0.0024 | — | — | — | — | — | — |
| V | 0.14 | 0.57 | 0.13 | 0.005 | 0.028 | 0.003 | 1.08 | 0.0038 | 0.0036 | 1.74 | — | — | — | — | — |
| AA | 0.16 | 0.53 | 0.89 | 0.003 | 0.032 | 0.023 | 1.54 | 0.0033 | 0.0032 | 1.23 | — | — | — | — | — |
| E | 0.21 | 0.79 | 0.75 | 0.004 | 0.042 | 0.042 | 3.66 | 0.0032 | 0.0045 | — | 2.53 | — | — | — | — |
| F | 0.16 | 0.73 | 1.07 | 0.004 | 0.011 | 0.015 | 2.48 | 0.0036 | 0.0040 | — | — | 3.15 | — | — | — |
| G | 0.11 | 0.37 | 1.27 | 0.004 | 0.050 | 0.026 | 2.38 | 0.0042 | 0.0028 | — | — | — | 0.53 | 0.29 | 0.38 |
| H | 0.15 | 0.29 | 0.21 | 0.002 | 0.033 | 0.050 | 4.24 | 0.0048 | 0.0037 | — | — | — | — | — | — |
| I | 0.20 | 0.24 | 0.35 | 0.004 | 0.043 | 0.001 | 2.44 | 0.0020 | 0.0038 | 0.53 | — | — | — | — | — |
| J | 0.18 | 0.70 | 1.02 | 0.003 | 0.049 | 0.040 | 4.76 | 0.0033 | 0.0045 | — | — | 2.95 | — | — | — |
| K | 0.08 | 0.17 | 1.99 | 0.002 | 0.013 | 0.050 | 1.58 | 0.0045 | 0.0030 | 0.51 | — | — | — | — | — |
| W | 0.25 | 0.31 | 1.10 | 0.004 | 0.025 | 0.022 | 1.13 | 0.0052 | 0.0033 | 0.21 | — | — | — | — | — |
| M | 0.10 | 1.03 | 0.89 | 0.003 | 0.020 | 0.046 | 3.44 | 0.0031 | 0.0011 | — | — | — | — | — | — |
| AB | 0.12 | 0.25 | 0.07 | 0.004 | 0.023 | 0.038 | 1.87 | 0.0039 | 0.0028 | 0.21 | — | — | — | — | — |
| N | 0.21 | 0.60 | 2.13 | 0.002 | 0.042 | 0.043 | 4.19 | 0.0038 | 0.0023 | — | — | — | — | — | — |
| X | 0.12 | 0.22 | 1.85 | 0.070 | 0.088 | 0.022 | 2.35 | 0.0010 | 0.0013 | — | — | — | — | — | — |
| P | 0.21 | 0.68 | 0.78 | 0.004 | 0.047 | 0.062 | 4.32 | 0.0028 | 0.0045 | — | — | — | — | — | — |
| Y | 0.22 | 0.38 | 0.85 | 0.004 | 0.033 | 0.048 | 0.81 | 0.0028 | 0.0045 | 0.73 | — | — | — | — | — |
| R | 0.23 | 0.49 | 1.29 | 0.005 | 0.023 | 0.020 | 5.12 | 0.0021 | 0.0011 | — | — | — | — | — | — |
| S | 0.21 | 0.86 | 0.37 | 0.003 | 0.014 | 0.032 | 3.54 | 0.0114 | 0.0131 | — | — | — | — | — | — |
| Q | 0.18 | 0.16 | 0.80 | 0.002 | 0.022 | 0.048 | 2.01 | 0.0048 | 0.0046 | — | — | — | — | — | — |
| Z | 0.22 | 0.52 | 1.35 | 0.004 | 0.028 | 0.018 | 2.23 | 0.0033 | 0.0018 | 1.43 | — | — | — | — | — |
| U | 0.15 | 0.14 | 0.51 | 0.002 | 0.047 | 0.027 | 0.04 | 0.0035 | 0.0030 | — | — | — | — | — | — |

| Steel sample ID | (mass %) Nb | Ti | B | Ca | Mg | REM | 0.45Cr + Mo | $Ar_3$ (° C.) | $Ac_3$ (° C.) | Mf (° C.) | Classification |
|---|---|---|---|---|---|---|---|---|---|---|---|
| A | — | — | — | — | — | — | 1.06 | 732 | 822 | 253 | Conforming steel |
| B | — | — | — | — | — | — | 2.07 | 683 | 780 | 179 | Conforming steel |
| C | — | — | — | — | — | — | 1.37 | 731 | 828 | 248 | Conforming steel |
| V | — | — | — | — | — | — | 2.23 | 829 | 908 | 315 | Conforming steel |
| AA | — | — | — | — | — | — | 1.92 | 765 | 872 | 272 | Conforming steel |
| E | — | — | — | — | — | — | 1.65 | 726 | 718 | 167 | Conforming steel |
| F | — | — | — | — | — | — | 1.12 | 568 | 783 | 189 | Conforming steel |
| G | — | — | — | — | — | — | 1.07 | 748 | 837 | 268 | Conforming steel |
| H | 0.018 | 0.015 | 0.0012 | — | — | — | 1.91 | 786 | 820 | 255 | Conforming steel |
| I | — | — | — | 0.0023 | — | — | 1.63 | 786 | 839 | 263 | Conforming steel |
| J | 0.013 | 0.012 | 0.0021 | — | 0.0032 | 0.0018 | 2.14 | 541 | 748 | 142 | Conforming steel |
| K | — | — | — | — | — | — | 1.22 | 711 | 844 | 268 | Comparative steel |
| W | — | — | — | — | — | — | 1.08 | 708 | 806 | 220 | Comparative steel |
| M | — | — | — | — | — | — | 1.55 | 762 | 852 | 260 | Comparative steel |
| AB | — | — | — | — | — | — | 1.05 | 840 | 867 | 319 | Comparative steel |
| N | — | — | — | — | — | — | 1.89 | 628 | 777 | 157 | Comparative steel |
| X | — | — | — | — | — | — | 1.06 | 703 | 819 | 244 | Comparative steel |
| P | — | — | — | — | — | — | 1.94 | 768 | 856 | 267 | Comparative steel |
| Y | — | — | — | — | — | — | 1.09 | 726 | 805 | 205 | Comparative steel |
| R | — | — | — | — | — | — | 2.30 | 670 | 772 | 163 | Comparative steel |
| S | — | — | — | — | — | — | 1.59 | 769 | 831 | 235 | Comparative steel |
| Q | — | — | — | — | — | — | 0.90 | 770 | 829 | 266 | Comparative steel |
| Z | — | — | — | — | — | — | 2.43 | 701 | 841 | 215 | Comparative steel |
| U | — | — | — | — | — | — | 0.02 | 831 | 871 | 328 | Comparative steel (mild steel) |

Note:
underline indicates it is outside the scope of the present disclosure.

TABLE 2

| Steel plate No. | Steel sample ID | Material thickness (mm) | Plate thickness (mm) | Hot rolling: Heating temperature (° C.) | Rolling finish temperature (° C.) | Quenching start temperature (° C.) | Quenching stop temperature (° C.) | Cooling rate (° C./s) | Reheating treatment: Reheating quenching start temperature (° C.) | Quenching stop temperature (° C.) |
|---|---|---|---|---|---|---|---|---|---|---|
| 1 | A | 250 | 25 | 1150 | 870 | — | — | — | 900 | 50 |
| 2 | A | 250 | 25 | 1150 | 870 | — | — | — | 830 | 100 |

TABLE 2-continued

| | | | | | | | | | | |
|---|---|---|---|---|---|---|---|---|---|---|
| 3 | A | 250 | 25 | 1150 | 870 | — | — | — | 880 | 210 |
| 4 | A | 250 | 25 | 1150 | 890 | — | — | — | 700 | 30 |
| 5 | A | 250 | 25 | 1150 | 890 | — | — | — | 870 | 300 |
| 6 | A | 250 | 25 | 1150 | 880 | — | — | — | 880 | 110 |
| 7 | B | 250 | 32 | 1180 | 880 | 840 | 140 | 25 | — | — |
| 8 | B | 250 | 32 | 1180 | 890 | 720 | 100 | 30 | — | — |
| 9 | B | 250 | 32 | 1180 | 890 | 830 | 160 | 30 | — | — |
| 10 | B | 250 | 32 | 1180 | 880 | 670 | 170 | 30 | — | — |
| 11 | B | 250 | 32 | 1180 | 890 | 850 | 230 | 30 | — | — |
| 12 | B | 250 | 32 | 1180 | 890 | 850 | 100 | 0.5 | — | — |
| 13 | C | 300 | 32 | 1150 | 890 | — | — | — | 880 | 30 |
| 14 | V | 300 | 32 | 1150 | 880 | — | — | — | 920 | 60 |
| 15 | AA | 300 | 32 | 1150 | 880 | — | — | — | 900 | 50 |
| 16 | E | 300 | 32 | 1150 | 870 | — | — | — | 900 | 40 |
| 17 | F | 300 | 32 | 1150 | 890 | — | — | — | 850 | 20 |
| 18 | G | 300 | 32 | 1150 | 900 | — | — | — | 870 | 100 |
| 19 | H | 300 | 50 | 1150 | 870 | — | — | — | 900 | 80 |
| 20 | I | 300 | 50 | 1150 | 880 | — | — | — | 870 | 60 |
| 21 | J | 300 | 50 | 1150 | 870 | — | — | — | 880 | 90 |
| 22 | J | 300 | 75 | 1150 | 890 | — | — | — | 880 | 100 |
| 23 | J | 300 | 100 | 1150 | 880 | — | — | — | 870 | 60 |
| 24 | K | 250 | 25 | 1150 | 900 | — | — | — | 880 | 100 |
| 25 | W | 250 | 25 | 1150 | 880 | — | — | — | 880 | 90 |
| 26 | M | 250 | 25 | 1150 | 880 | — | — | — | 900 | 100 |
| 36 | AB | 250 | 25 | 1150 | 900 | — | — | — | 890 | 50 |
| 27 | N | 250 | 25 | 1150 | 880 | — | — | — | 880 | 60 |
| 28 | X | 250 | 25 | 1150 | 900 | — | — | — | 890 | 80 |
| 29 | P | 250 | 25 | 1150 | 880 | — | — | — | 880 | 90 |
| 30 | Y | 250 | 25 | 1150 | 880 | — | — | — | 860 | 100 |
| 31 | R | 250 | 25 | 1150 | 890 | — | — | — | 900 | 90 |
| 32 | S | 250 | 25 | 1150 | 890 | — | — | — | 900 | 70 |
| 33 | Q | 250 | 25 | 1150 | 890 | — | — | — | 890 | 70 |
| 34 | Z | 250 | 25 | 1150 | 890 | — | — | — | 880 | 80 |
| 35 | U | 250 | 25 | 1150 | 890 | 840 | 50 | 0.1 | — | — |

| | | Microstructure | | Properties | | | | |
|---|---|---|---|---|---|---|---|---|
| | | | | | | Wear resistance | | |
| Steel plate No. | Reheating treatment Cooling rate (° C./s) | Fraction of martensite micro-structure (%) | Residual micro-structure (*) | Surface layer hardness (HBW10/3000) | Hardness at 400° C. (HV400) | at high temperatures (400° C.) (ratio to mild steel) | Charpy absorbed energy at −40° C. (J) | Classification |
| 1 | 40 | 99 | B | 398 | 338 | 1.9 | 76 | Example |
| 2 | 45 | 96 | B | 386 | 336 | 1.8 | 86 | Example |
| 3 | 45 | 97 | B | 390 | 332 | 1.8 | 83 | Example |
| 4 | 40 | 79 | F | 318 | 277 | 1.4 | 77 | Comparative Example |
| 5 | 40 | 84 | B | 338 | 281 | 1.5 | 116 | Comparative Example |
| 6 | 0.3 | 0 | F + P | 203 | 193 | 1.0 | 238 | Comparative Example |
| 7 | — | 97 | B | 453 | 435 | 2.2 | 34 | Example |
| 8 | — | 99 | B | 463 | 440 | 2.2 | 28 | Example |
| 9 | — | 98 | B | 458 | 426 | 2.1 | 35 | Example |
| 10 | — | 73 | F | 341 | 283 | 1.7 | 67 | Comparative Example |
| 11 | — | 75 | B | 349 | 286 | 1.7 | 55 | Comparative Example |
| 12 | — | 0 | F + P | 221 | 214 | 1.0 | 178 | Comparative Example |
| 13 | 25 | 99 | B | 382 | 371 | 1.9 | 56 | Example |
| 14 | 30 | 97 | B | 390 | 374 | 1.8 | 78 | Example |
| 15 | 30 | 98 | B | 410 | 380 | 1.9 | 58 | Example |
| 16 | 30 | 98 | B | 450 | 423 | 2.1 | 32 | Example |
| 17 | 25 | 99 | B | 414 | 364 | 1.8 | 47 | Example |
| 18 | 25 | 98 | B | 370 | 315 | 1.8 | 78 | Example |
| 19 | 15 | 98 | B | 402 | 374 | 1.9 | 60 | Example |
| 20 | 20 | 99 | B | 446 | 428 | 2.1 | 33 | Example |
| 21 | 20 | 97 | B | 422 | 405 | 2.0 | 36 | Example |
| 22 | 25 | 96 | B | 457 | 423 | 2.1 | 34 | Example |
| 23 | 20 | 96 | B | 448 | 426 | 2.1 | 37 | Example |
| 24 | 45 | 96 | B | 334 | 287 | 1.6 | 113 | Comparative Example |
| 25 | 40 | 98 | B | 492 | 228 | 1.2 | 14 | Comparative Example |
| 26 | 40 | 98 | B | 362 | 359 | 1.8 | 16 | Comparative Example |
| 36 | 45 | 97 | B | 374 | 283 | 1.5 | 58 | Comparative Example |
| 27 | 40 | 99 | B | 454 | 436 | 2.2 | 14 | Comparative Example |
| 28 | 45 | 99 | B | 382 | 377 | 1.8 | 13 | Comparative Example |
| 29 | 40 | 97 | B | 445 | 419 | 2.1 | 14 | Comparative Example |
| 30 | 40 | 98 | B | 458 | 402 | 1.2 | 77 | Comparative Example |
| 31 | 40 | 98 | B | 466 | 456 | 2.3 | 18 | Comparative Example |

TABLE 2-continued

| | | | | | | | | |
|---|---|---|---|---|---|---|---|---|
| 32 | 40 | 99 | B | 454 | 377 | 1.9 | 23 | Comparative Example |
| 33 | 45 | 98 | B | 420 | 286 | 1.6 | 51 | Comparative Example |
| 34 | 40 | 97 | B | 452 | 445 | 2.3 | 20 | Comparative Example |
| 35 | — | 0 | F + P | 126 | 121 | 1.0 | 181 | Comparative Example |

Note:
underline indicates it is outside the scope of the present disclosure.
(*) F: Ferrite, B: Bainite, P: Pearlite As can be seen from Tables 1 and 2, Examples all have a hardness at 25° C. at a depth of 1 mm from the surface of 360 HBW10/3000 to 490 HBW10/3000 in Brinell hardness, a wear resistance ratio at high temperatures of 1.8 or more, and an absorbed energy at −40° C. of 27 J or more, and Examples all obtain a wear-resistant steel plate having excellent wear resistance at high temperatures and toughness at low temperatures. On the other hand, steel plates No. 4, 5, 6, 10, 1 1 and 12, which are Comparative Examples, differ from Examples in terms of hardness of surface layer or fraction of martensite microstructure, and the wear resistance at high temperatures is inferior to that of Examples. In the steel plate No. 24 that is Comparative Example, the carbon content is low, the fraction of martensite microstructure is different from that of Examples, and the wear resistance at high temperatures is inferior to that of Examples. In the steel plate No. 25, the carbon content is high, the hardness of the surface layer is different from that of Examples, and the wear resistance at high temperatures and the toughness at low temperatures are inferior to that of Examples.

Steel plates Nos. 26, 27, 28, 29, 31 and 32 have more additions of various elements than Examples, and their toughness at low temperatures is inferior to that of Examples. In the steel plate No. 30, the amount of Cr added is less than that of Examples, and the wear resistance at high temperatures is inferior to that of Examples. In the steel plate No. 33 where 0.45 Cr+Mo<1.0, the wear resistance at high temperatures is inferior to that of Examples. Further, in the steel plate No. 34 where 2.25<0.45 Cr+Mo, the toughness at low temperatures is inferior to that of Examples.

The invention claimed is:

1. A wear-resistant steel plate, comprising
a chemical composition containing, in mass %,
C: 0.10% or more and 0.23% or less,
Si: 0.05% or more and 1.00% or less,
Mn: 0.10% or more and 2.00% or less,
P: 0.050% or less,
S: 0.050% or less,
Al: 0.050% or less,
Cr: 1.00% or more and 5.00% or less,
N: 0.0100% or less, and
O: 0.0100% or less,
with the balance being Fe and inevitable impurities, wherein
the chemical composition satisfies the formula (1)

$$1.00 \leq 0.45Cr+Mo \leq 2.25 \quad (1),$$

where the element symbol in the formula (1) is a content of each element in mass %, and a content of an element that is not contained is 0, and
a microstructure wherein
a volume fraction of martensite at a depth of 1 mm from a surface of the steel plate is 95% or more, and
at a depth of 1 mm from a surface of the steel plate, a Vickers hardness at 400° C. is 288 or more, and a Brinell hardness at 25° C. is 360 HBW10/3000 to 490 HBW10/3000.

2. The wear-resistant steel plate according to claim 1, wherein the chemical composition further contains, in mass %, at least one selected from the group consisting of
Mo: 1.80% or less,
Cu: 5.00% or less,
Ni: 5.00% or less,
V: 1.00% or less,
W: 1.00% or less,
Co: 1.00% or less,
Nb: 0.050% or less,
Ti: 0.100% or less,
B: 0.0100% or less,
Ca: 0.0200% or less,
Mg: 0.0200% or less, and
REM: 0.0200% or less.

3. A method for producing a wear-resistant steel plate, which is a method for producing the wear-resistant steel plate according to claim 1, comprising
subjecting a steel material to hot rolling to obtain a hot-rolled steel plate, and subjecting the hot-rolled steel plate to direct quenching where a cooling start temperature is equal to or higher than $Ar_3$ transformation point, a cooling stop temperature is equal to or lower than Ms point, and a cooling rate is 5° C./s or higher, or to reheating quenching where a cooling start temperature is equal to or higher than $Ac_3$ transformation point, a cooling stop temperature is equal to or lower than Mf point, and a cooling rate is 5° C./s or higher.

4. A method for producing a wear-resistant steel plate, which is a method for producing the wear-resistant steel plate according to claim 2, comprising
subjecting a steel material to hot rolling to obtain a hot-rolled steel plate, and subjecting the hot-rolled steel plate to direct quenching where a cooling start temperature is equal to or higher than $Ar_3$ transformation point, a cooling stop temperature is equal to or lower than Ms point, and a cooling rate is 5° C./s or higher, or to reheating quenching where a cooling start temperature is equal to or higher than $Ac_3$ transformation point, a cooling stop temperature is equal to or lower than Mf point, and a cooling rate is 5° C./s or higher.

* * * * *